US006575551B2

(12) United States Patent
Watanabe

(10) Patent No.: US 6,575,551 B2
(45) Date of Patent: Jun. 10, 2003

(54) INK JET HEAD AND INK JET RECORDING APPARATUS

(75) Inventor: Yoshiaki Watanabe, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 10/147,422

(22) Filed: May 16, 2002

(65) Prior Publication Data

US 2002/0180842 A1 Dec. 5, 2002

(30) Foreign Application Priority Data

May 24, 2001 (JP) ..... 2001-155261

(51) Int. Cl.[7] ..... B41J 29/393; B41J 29/38
(52) U.S. Cl. ..... 347/19; 347/11
(58) Field of Search ..... 347/19, 14, 11, 347/15, 68, 69, 70, 71, 8–10, 20; 400/668

(56) References Cited

U.S. PATENT DOCUMENTS 6,010,204 A * 1/2000 Morioka et al. ..... 347/37
6,186,610 B1 * 2/2001 Kocher et al. ..... 347/11

* cited by examiner

*Primary Examiner*—Craig Hallacher
*Assistant Examiner*—Charles W. Stewart, Jr.
(74) *Attorney, Agent, or Firm*—Adams & Wilks

(57) ABSTRACT

There are provided an ink jet head and an ink jet recording apparatus having a judging unit for making a judgment with ease on an ink filling state of a printing head without consuming any ink and recording medium that are used for verification. A controlling means 500 controls a selection means 300 to drive one of side walls adjacently disposed in ink passages provided on a head chip 200 and obtains a piezoelectric signal generated on the other one of the side walls from a signal processing means 400, to thereby judge the ink filling state in the ink passage.

10 Claims, 7 Drawing Sheets

INK JET HEAD AND INK JET RECORDING APPARATUS

BACKGROUND OF THE INVENTION

1. Field of the Invention

The present invention relates to an ink jet head, which is characterized in its capability of judging an ink filling state in an ink passage, for instance, in an ink jet head mounted on an ink jet recording apparatus which is applied to a printer or a fax machine, and to an ink jet recording apparatus provided with the ink jet head.

2. Description of the Related Art

Conventionally, there is known an ink jet recording apparatus that records characters and images on a medium to be recorded using a recording head which ejects ink from a plurality of nozzles. In such an ink jet recording apparatus, the recording head which opposes the medium to be recorded is provided in a head holder, and this head holder is mounted on a carriage to be scanned in a direction orthogonal to a conveying direction of the medium to be recorded.

A schematic exploded view of an example of such a recording head is shown in FIG. 8 and a sectional view of main parts of the same is shown in FIG. 9. As shown in FIGS. 8 and 9, a plurality of grooves 102 are provided in parallel with each other in a piezoelectric ceramic plate 101, and each groove 102 is separated by side walls 103. An end portion in a longitudinal direction of each groove 102 is extended to an end surface of the piezoelectric ceramic plate 101 and the other end portion is not extended to the other end surface, making the groove 102 to be gradually shallow. In addition, electrodes 105 for applying a driving electric field are formed on surfaces on opening-side surface of both the side walls 103 in each groove 102 throughout its longitudinal direction.

A cover plate 107 is bonded on the opening side of the grooves 102 of the piezoelectric ceramic plate 101 using adhesive 109. The cover plate 107 includes an ink chamber 111 to be a recessed portion communicating with the other end portion where each groove 102 is shallow and an ink supply port 112 that is bored from the bottom portion of this ink chamber 111 in a direction opposite to the grooves 102.

In addition, a nozzle plate 115 is bonded to an end surface of a bonded body of the piezoelectric ceramic plate 101 and the cover plate 107 in which the grooves 102 are opened, and nozzle openings 117 are formed in positions opposing the respective grooves 102 of the nozzle plate 115.

Note that, a wiring substrate 120 is fixed to the surface of the piezoelectric ceramic plate 101 on the other side of the nozzle plate 115 and on the other side of the cover plate 107. Wiring 122 connected by each electrode 105, bonding wires 121 and the like is formed on the wiring substrate 120, and a driving voltage can be applied to the electrodes 105 via this wiring 122.

In a recording head configured in this way, when each groove 102 is filled with ink from the ink supply port 112 and a predetermined driving electric field is caused to act on the side walls 103 on both sides of the predetermined groove 102 via the electrode 105, the side walls 103 are deformed to change the volume of the predetermined groove 102, whereby the ink in the groove 102 is ejected from the nozzle opening 117.

In such a recording head, oscillation energy generated on a side wall is transmitted to ink in a passage, to thereby realize ink ejection. For realizing the above, it is necessary that ink be sufficiently filled in the passage without producing any gap. However, for instance, in the case where the first ink filling is conducted to the recording head or ink is exchanged, a part of the passage is not occasionally filled with ink or the passage occasionally involves generation of air bubbles. When the passage contains such filling defect, the oscillation energy generated on the side wall is not sufficiently transmitted to ink, thereby causing printing defect in which ink is not ejected and the like.

Conventionally, in order to prevent such printing defect from causing, actual printing is carried out on a recording medium such as a piece of paper or the like in advance, and there is made a judgment through visual observation whether all nozzles properly eject ink, and then such a treatment as to refill ink has been performed in the case of containing defect. However, there are problems that a large amount of time and effort as well as consumption of ink and recording mediums used for the verification are required.

In addition, as a method of automatically detecting such printing defect in advance, there is devised an apparatus in which, for instance, an ejected ink drop is detected using an optical method, to thereby judge whether ink filling has been properly conducted or not. However, the method still leaves the consumption of ink and needs another means for detecting the ink drop. Therefore, there is a problem in that the apparatus is complicatedly constructed.

SUMMARY OF THE INVENTION

The present invention has been made in view of the above, and an object of the present invention is to provide an ink jet head and an ink jet recording apparatus, provided with means for easily judging an ink filling state of a printing head, with which ink and recording mediums for verification are not consumed.

To solve the above-described problems, according to a first aspect of the present invention, there is provided an ink jet head in which a driving voltage is applied to an electrode, provided on a side wall of an ink passage formed on a piezoelectric ceramic plate, to change a volume of the ink passage, thereby ejecting ink, filled with the interior thereof through a nozzle opening; the ink jet head characterized by comprising: a signal processing means for processing a piezoelectric signal generated on an electrode provided on each of the side walls of the ink passage; a selection means composed of a group of switches that are equipped for connecting the electrode, provided on each of the side walls of the ink passage, with any one of the driving voltage, a reference voltage and the signal processing means; and a control means for controlling the selection means, and the control means is provided with a judging means for judging a filling state of ink in the ink passage through processes in which the selection means is controlled, one of the side walls that are adjacently disposed in the ink passage is driven and a piezoelectric signal that is generated on the other one of the side walls is detected.

According to a second aspect of the present invention, in an ink jet head of the first aspect, there is provided an ink jet head characterized by comprising a diagnosis signal generating means for generating a diagnosis signal for driving the side walls of the ink passage; and a signal switching means for selecting any one of the driving voltage and the diagnosis signal to connect with the selection means, and the diagnosis signal is connected with the selection means by the signal switching means in detection of a filling state of ink and the diagnosis signal is applied to one of the side walls adjacently disposed, selected by the selection means.

According to a third aspect of the present invention, in an ink jet head of the second aspect, there is provided an ink jet head in which the driving means is composed of a pulse generating circuit.

According to a fourth aspect of the present invention, in an ink jet head of the second aspect, there is provided an ink jet head in which the driving means is composed of a sine wave generating circuit.

According to a fifth aspect of the present invention, in an ink jet head of the second aspect, there is provided an ink jet head in which the driving means is composed of a sweep signal generating circuit.

According to a sixth aspect of the present invention, there is provided an ink jet recording apparatus having an ink jet head in which a driving voltage is applied to an electrode, provided on a side wall of an ink passage formed on a piezoelectric ceramic plate, to change a volume of the ink passage, thereby ejecting ink, filled in the interior thereof through a nozzle opening, the ink jet recording apparatus characterized by comprising: a signal processing means for processing a piezoelectric signal generated on an electrode provided on each of the side walls of the ink jet head; a selection means composed of a group of switches that are equipped for connecting the electrode, provided on each of the side walls of the ink passage, with any one of the driving voltage, a reference voltage and the signal processing means; and a control means for controlling the selection means, and the control means is provided with a judging means for judging a filling state of ink in the ink passage, through processes in which the selection means is controlled, one of the sidewalls that are adjacently disposed in the ink passage is driven and a piezoelectric signal that is generated on the other one of the side walls is detected.

According to a seventh aspect of the present invention, in an ink jet recording apparatus of the sixth aspect, there is provided an ink jet recording apparatus characterized by comprising: a diagnosis signal generating means for generating a diagnosis signal for driving the side walls of the ink passage; and a signal switching means for selecting any one of the driving voltage and the diagnosis signal to connect with the selection means, and the diagnosis signal is connected with the selection means by the signal switching means in detection of a filling state of ink and the diagnosis signal is applied to one of the side walls adjacently disposed, selected by the selection means.

According to an eighth aspect of the present invention, in an ink jet recording apparatus of the seventh aspect, there is provided an ink jet recording apparatus in which the driving means is composed of a pulse generating circuit.

According to a ninth aspect of the present invention, in an ink jet recording apparatus of the seventh aspect, there is provided an ink jet recording apparatus in which the driving means is composed of a sine wave generating circuit, which is described in claim 6.

According to a tenth aspect of the present invention, in an ink jet recording apparatus of the seventh aspect, there is provided an ink jet recording apparatus in which the driving means is composed of a sweep signal generating circuit.

The present invention is capable of easily making a judgment regarding the ink filling state of a printing head without consuming any ink and recording medium that are used for verification, resulting in leading an expectation to exhibit a considerable effect in reduction of printing cost and enhancement of printing quality.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

The detailed description of the present invention is made based on embodiments of the present invention below.

(Embodiment 1)

Figure 1A:
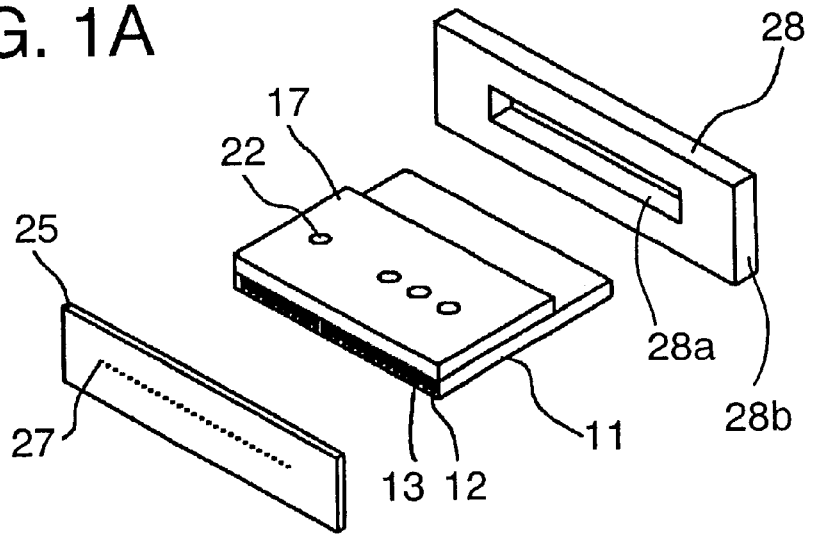
FIG. 1 is an exploded perspective view and a sectional view showing a head chip according to Embodiment 1 of the present invention.
Figure 1B:
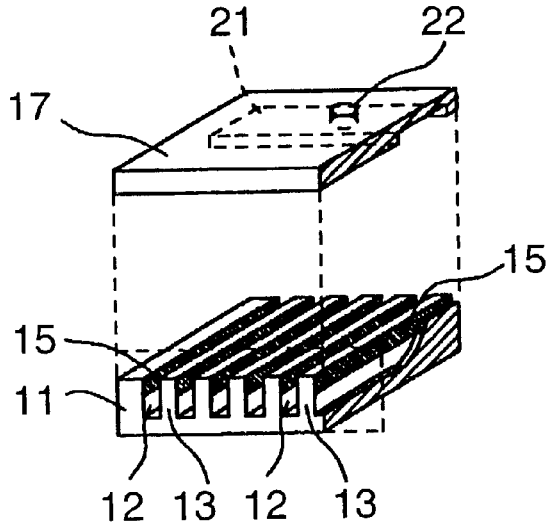

FIG. 1 is an exploded perspective view showing a head chip according to Embodiment 1 of the present invention. As shown in FIG. 1, in a piezoelectric ceramic plate 11, a plurality of grooves 12 are parallelly disposed and each of the grooves 12 is separated by side walls 13. One end portion of each groove 12 in a longitudinal direction is disposed so as to be extended to one end surface of the piezoelectric ceramic plate 11. The other end portion of each groove 12 is disposed not being extended to the other end surface of the piezoelectric ceramic plate, and the depth thereof is gradually reduced. Also, on an opening-side surface of both the side walls 13 of each groove 12, an electrode 15 for application of a driving electric field 15 is formed across the longitudinal direction.

Here, each groove 12 is formed on the piezoelectric ceramic plate 11 with, for instance, a disk-shaped dice cutter, the shape of which is utilized to form the portion where the depth is gradually reduced. In addition, the electrode 15 is formed inside each groove 12 through, for instance, known evaporation which is performed from a slant direction.

A cover plate 17 is bonded to the opening side of the groove 12 of such a piezoelectric ceramic plate 11. The cover plate 17 includes an ink chamber 21 forming a recess portion with which the other end portion of each groove 12 having the reduced depth is communicated and an ink supply port 22 disposed so as to be penetrated from the bottom portion of the ink chamber 21 toward the direction opposite to the groove 12.

Here, in this embodiment, each groove 12 is separated into groups corresponding to each ink color such as black (B), yellow (Y), magenta (M) and cyan (C), and the ink chambers 21 and the ink supply ports 22 each are separated into four chambers.

Note that it is possible for the cover plate 17 to be formed of a ceramic plate or a metallic plate and the like. However, when considering its deformation after the piezoelectric ceramic plate 11 is bonded thereto, the cover plate 17 is preferably formed of a ceramic plate having a coefficient of thermal expansion close to that thereof.

Also, to an end surface in which the groove 12 of a bonded body of the piezoelectric ceramic plate 11 and the cover plate 17 is opened, a nozzle plate 25 is bonded. A nozzle opening 27 is formed at a position where the nozzle plate 25 faces each groove 12.

In the present embodiment, the size of the nozzle plate 25 is larger than the end surface in which the groove 12 of the bonded body of the piezoelectric ceramic plate 11 and the cover plate 17 is opened. Further, the nozzle plate 25 is formed of a polyimide film or the like which is provided with the nozzle opening 27 thereon through an excimer laser apparatus, for instance.

Note that, on the periphery of the end portion in which the groove 12 of the bonded body of the piezoelectric ceramic plate 11 and the cover plate 17 is opened, a nozzle support plate 28 is disposed. The nozzle support plate 28 is bonded to the outside of the bonded body end surface of the nozzle plate and employed in order to hold the nozzle plate 25 in a stable manner. Needless to say, the nozzle support plate 28 may not be necessarily equipped.

In addition, there is no particular limitation on arrangement of wirings or the like, that are used for driving such a head chip 30. However, the description is given as an example below.

Figure 2:
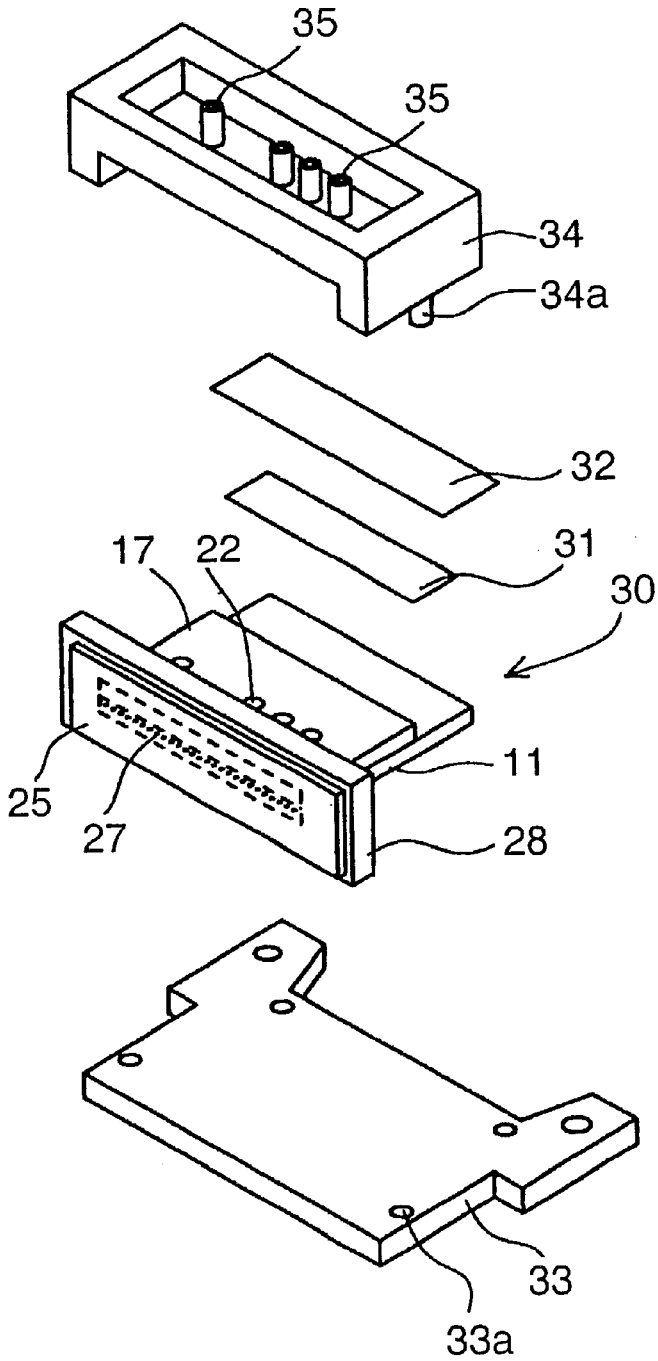
FIG. 2 is an exploded perspective view showing an ink jet head according to Embodiment 1 of the present invention.
Figure 3A:
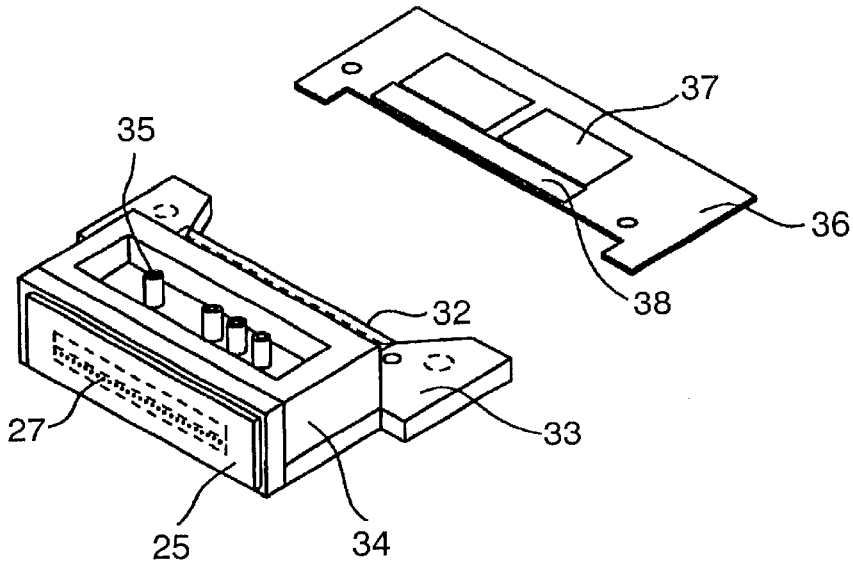
FIG. 3 is a perspective views showing a process of assembling an ink jet head according to Embodiment 1 of the present invention.
Figure 3B:
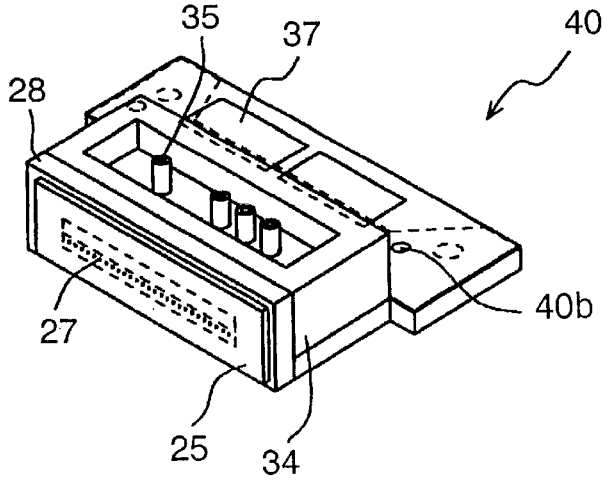

FIG. 2 and FIG. 3 show an example of a process of manufacturing an ink jet head 40 employing the above-mentioned head chip 30.

As shown in FIG. 2, on the end portion opposite to the nozzle opening side of the piezoelectric ceramic plate 11, a wiring pattern (not shown) is formed so as to be connected with the electrode 15. A flexible cable 32 is bonded to the wiring pattern through an anisotropic conductive film 31. Also, on the rear end side of the nozzle support plate 28 of the bonded body of the piezoelectric ceramic plate 11 and the cover plate 17, a base plate 33 made of aluminum that is disposed at the side of the piezoelectric ceramic plate 11 and a head cover 34 that is disposed at the side of the cover plate 17 are joined together. When an engaging shaft 34*a* of the head cover 34 is engaged with an engaging hole 33*a* of the base plate 33, the base plate 33 and the head cover 34 are fixed. The bonded body of the piezoelectric ceramic plate 11 and the cover plate 17 is sandwiched between the base plate 33 and the head cover 34. In the head cover 34, an ink leading channel 35 is provided so as to be brought in communication with each of the ink supply ports 22 of the cover plate 17.

Next, as shown in FIG. 3(*a*), on the base plate 33 that is protruded to the rear end side of the piezoelectric ceramic plate 11, a wiring substrate 36 is fixed and a circuit made thereon is connected with the flexible cable 32 through an anisotropic conductive film 38, to thereby complete the ink jet head 40 shown in FIG. 3(*b*).

Also, on the wiring substrate 36 of the present embodiment, there are mounted a selection means 37 for driving the head chip and a peripheral circuit, thereby composing a judging means for judging the ink filling state, by which the present invention is characterized. The detail will be described based on FIG. 4 and FIG. 5 below.

Figure 4:
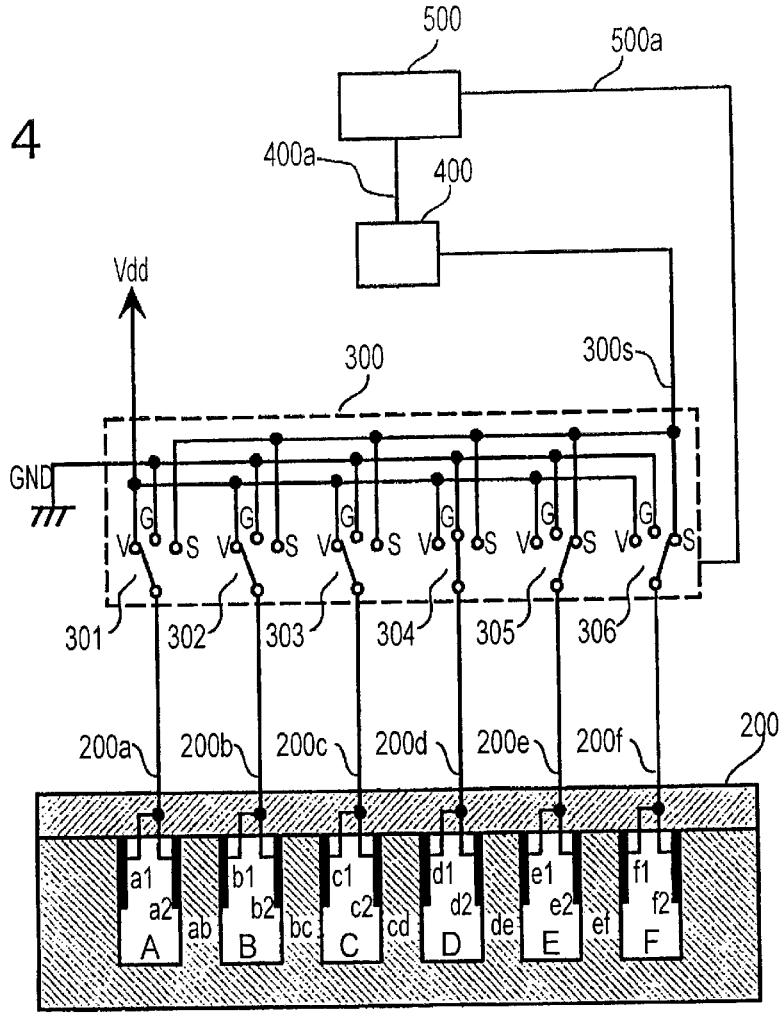
FIG. 4 is a schematic view showing main portions of an ink jet head according to Embodiment 1 of the present invention.

In FIG. 4, reference numeral 200 denotes a head chip and a diagonally shaded area shown therein designates the cross section of the piezoelectric ceramic plate viewed from an ink passage shaft. The cross section is composed of ink passages A to F, side walls ab to ef, electrodes a1 to f2 that are disposed along the passages. The electrodes consisting in one passage, for instance, a1 and a2, are connected through the end portions of the piezoelectric ceramic plate and are drawn out as wirings 200*a* to 200*f*.

A selection means 300 is a group of analogue switches, which are constructed by, for instance, a CMOS integrated circuit or the like. Respective switches 301 to 306 appropriately select a driving voltage Vdd (contact V), a reference electric potential GND (contact G) and a piezoelectric signal (contact S) 300*s*, to thereby be connected with each of the electrodes a1 to f2 of the head chip 200 through the wirings 200*a* to 200*f*.

A signal processing means 400 is constructed by, for instance, an operational amplifier circuit and the like, in which an output is produced as a detection signal 400*a* by amplifying, commutating and integrating the piezoelectric signal 300*s* that is selected by the selection means 300.

A controlling means 500 is constructed by, for instance, a commonly-used one chip microcontroller having an A/D converter and the like, in which a control signal 500*a* controls the selection means 300 and further judges the ink filling state based on the detection signal 400*a*.

Figure 5:
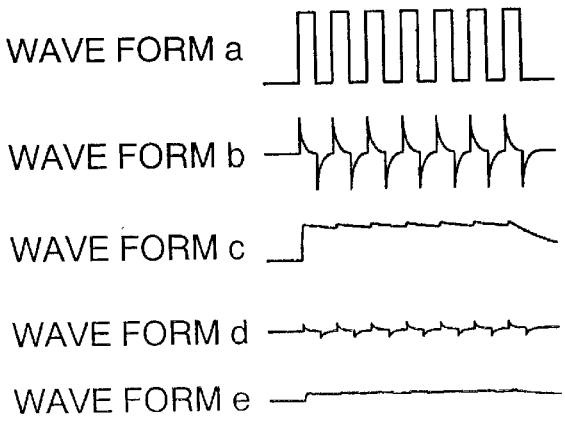
FIG. 5 is a diagram showing as an example voltage wave forms and detection wave forms of each of the portions according to the embodiment of the present invention.

For example, in the case where the ink filling state of a passage D is judged, the controlling means 500 is operated as follows: the switch 304 is connected with the reference electric potential GND (contact G) so as to be fixed, the switches 305 and 306 are connected with a detection common 300*s* (contact S) so as to be fixed and the switches 301 to 303 are connected with the driving voltage vdd (contact V) and the reference electric potential GND (contact G) in a repetitive manner through synchronizing the switches. In this way, a driving voltage, the wave form of which is shown as a wave form a in FIG. 5, is applied between the electrode c2 and the electrode d1 sandwiching the side wall cd, thus driving the side wall cd. Oscillation energy that is generated on the side wall cd is transmitted to the side wall de through ink filled in the passage D. The piezoelectric signal, the wave form of which is shown as a wave form b in FIG. 5, is generated between the electrode d2 and the electrode e1 sandwiching the side wall de. Through the wiring 200*e*, the switch 305 and the detection common 300*s*, this piezoelectric signal is connected with the signal processing means 400 to be amplified, commutated and integrated, to thereby produce an output for the controlling means 500, that is used as the detection signal 400*a*, the wave form of which is shown as a wave form c in FIG. 5.

Here, the piezoelectric signal that is generated on the side wall de includes a difference in amplification in accordance with the ink filling state of the passage D. For instance, when an air bubble is entered into the passage, the bubble contained in the ink prevents the oscillation energy from transmitting that is generated on the side wall cd and also induces attenuation of the piezoelectric signal that is generated on the side wall de which faces the side wall cd, as shown as a wave form d in FIG. 5. Further, according to this, the detection signal 400*a* is degraded as well, as shown as a wave form e in FIG. 5.

The controlling means 500 compares a voltage value of the detection signal 400*a* obtained in this manner with a predetermined threshold value. When the detection signal 400*a* has a higher voltage than the threshold value, the controlling means 500 becomes capable of making a judgment indicating that the passage D is properly filled with ink.

When the detection signal 400*a* has a lower voltage than the threshold value, the controlling means 500 becomes capable of making a judgment indicating that the passage D involves a filling defect such as presence of an air bubble. Further, the controlling means 500 controls the selection means 300 to conduct this judging operation to the other passages in a similar manner. When the controlling means 500 makes a judgment that all the passages are properly filled with ink, it is determined that actual printing operation, that is, ink ejection may be performed.

Although the detailed description will not be given with regard to the operation of ink ejection, the description thereof will be schematically made; For instance, there is given the case where ink in the passage D is ejected. By the controlling means 500, the switch 304 is connected with the reference electric potential GND (contact G) so as to be fixed and then all switches other than the switch 304 are synchronized and connected with the driving voltage Vdd (contact V) and the reference electric potential GND (contact G) at a predetermined timing in a repetitive manner. In this way, the driving voltage Vdd is applied between the electrode c2 and the electrode d1 and between the electrode d2 and the electrode e1, that is, to the side wall cd and to the side wall de. The volume of the passage D is changed due to electrostriction of the side wall, to thereby eject ink from a nozzle (not shown).

Figure 6:
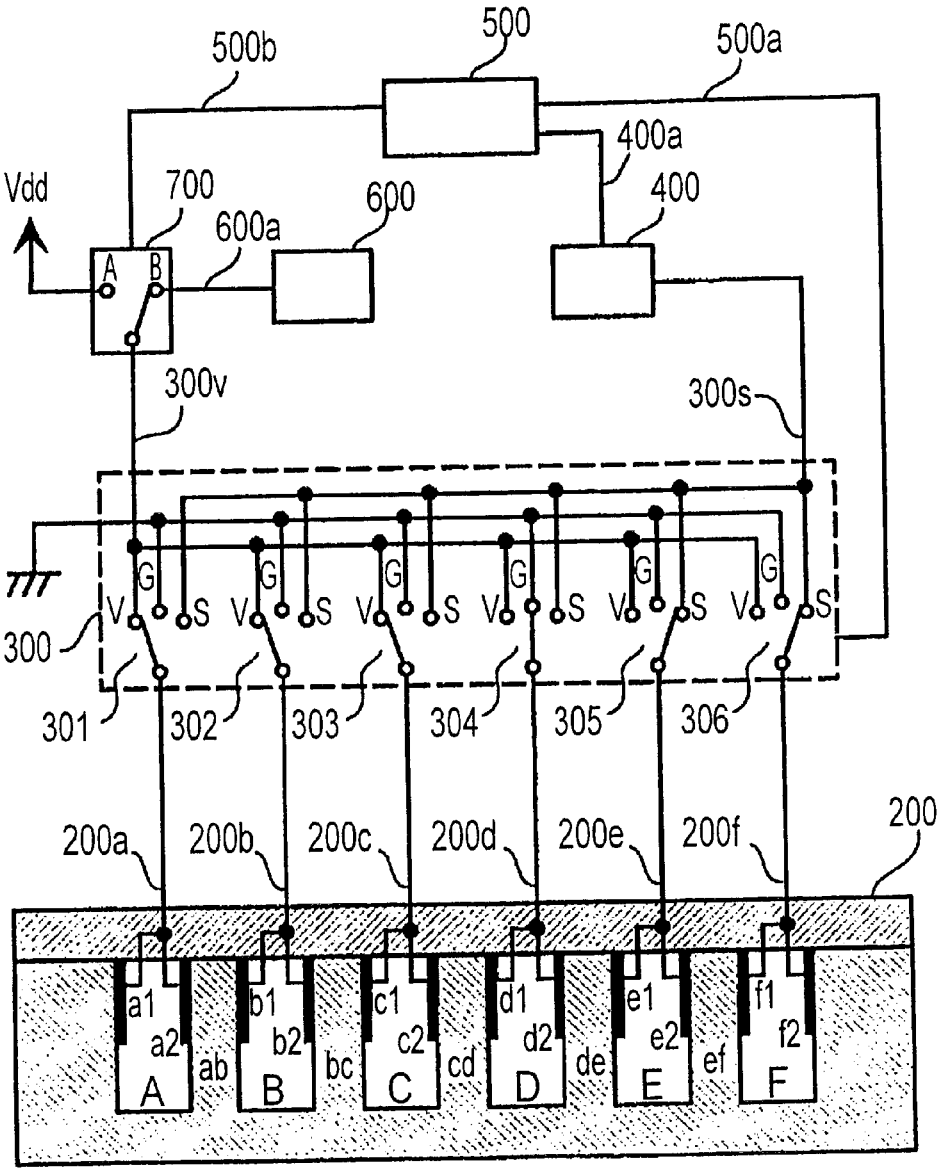
FIG. 6 is a schematic view showing main portions of an ink jet head according to Embodiment 2 of the present invention.

Next, the description of another embodiment of the present invention will be made with reference to FIG. 6.

(Embodiment 2)

In the present embodiment, in addition to the above construction of Embodiment 1, a diagnosis signal generating means 600 for giving a diagnosis signal 600*a* and a signal switching means 700 are provided. In the above-described Embodiment 1, in order to judge the filling state, the selection means 300 is switched to drive one of the side walls that are disposed to be faced each other. However, in Embodiment 2, the diagnosis signal generating means 600 produces an output as the diagnosis signal 600*a*, by which the above driving is carried out. The diagnosis signal generating means 600 is, for instance, an oscillation circuit having a rectangular wave, which is composed of a CMOS inverter circuit or the like. The outputted diagnosis signal 600*a* is a signal having a rectangular wave that is shown as a wave form a in FIG. 5. The operation of the present embodiment will be described below.

For instance, there is given the case where the ink filling state of the passage D is judged. A controlling means 500 controls the selection means 300 to connect a switch 304 with a reference electric potential GND (contact G) to be fixed, switches 305 and 306 with a detection common 300*s* (contact S) to be fixed and switches 301 to 303 with a driving voltage Vdd (contact V) to be fixed. In addition, in the controlling means 500, through a control signal 500*b*, the signal switching means 700 is connected with a contact point B and the diagnosis signal 600*a* is connected with the selection means 300. In this way, the diagnosis signal 600*a* is applied between the electrode c2 and the electrode d1 sandwiching the side wall cd, to thereby drive the side wall cd. The oscillation energy that is generated on the side wall cd is transmitted to the side wall de through ink filling the passage D, thus producing a piezoelectric signal between the electrode d2 and the electrode e1 sandwiching the side wall de, as shown as a wave form b in FIG. 5. Through a wiring 200*e*, the switch 305 and the detection common 300*s*, this piezoelectric signal is connected with a signal processing means 400 to be amplified, commutated and integrated, to thereby produce an output for the controlling means 500 as a detection signal 400*a*, the wave form of which is shown as a wave form c in FIG. 5.

Hereinafter, in a similar manner to that of Embodiment 1, the controlling means 500 compares a voltage value of the detection signal 400*a* with the predetermined threshold value, to thereby make the controlling means 500 capable of judging whether filling defect is contained in the passage D or not.

Note that, in the present embodiment, an oscillation circuit having a rectangular wave is employed for the diagnosis signal generating means 600 and a signal having a rectangular wave is applied for the diagnosis signal 600*a*. However, there is no limit to this wave form that can be applied as the diagnosis signal. For instance, a pulse wave form, a sine wave and a rectangular wave of a short-period or an interrupted wave of a sine wave may be used. In the case where a wave form is selected among these wave forms, in view of an oscillation transmitting property that is varied depending on the kind of ink to be used or the passage construction, a selection may be made of a wave form in which the ink filling state gives remarkable effect on the piezoelectric signal that is generated.

In addition, another method may be considered in which a sweep signal generating circuit is employed as the diagnosis signal generating means 600 and the diagnosis signal, the frequency or the amplification of which is varied with time, is applied to the side wall. In this way, it enables the ink filling state to be judged in more detail.

As described above, according to the present embodiment, it is possible to provide an ink jet head enabling the ink filling state to be judged by a commonly used electronic circuit without requiring a special detection apparatus and the like.

Figure 7:
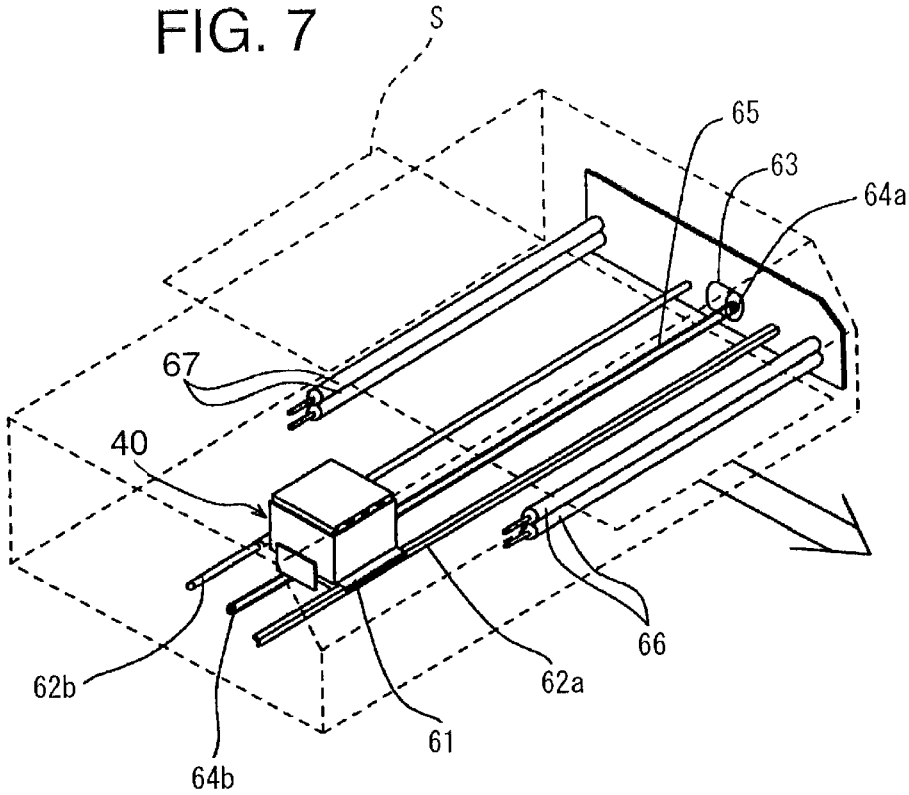
FIG. 7 is a perspective view showing an embodiment mode of an ink jet head according to an embodiment of the present invention.
Figure 8:
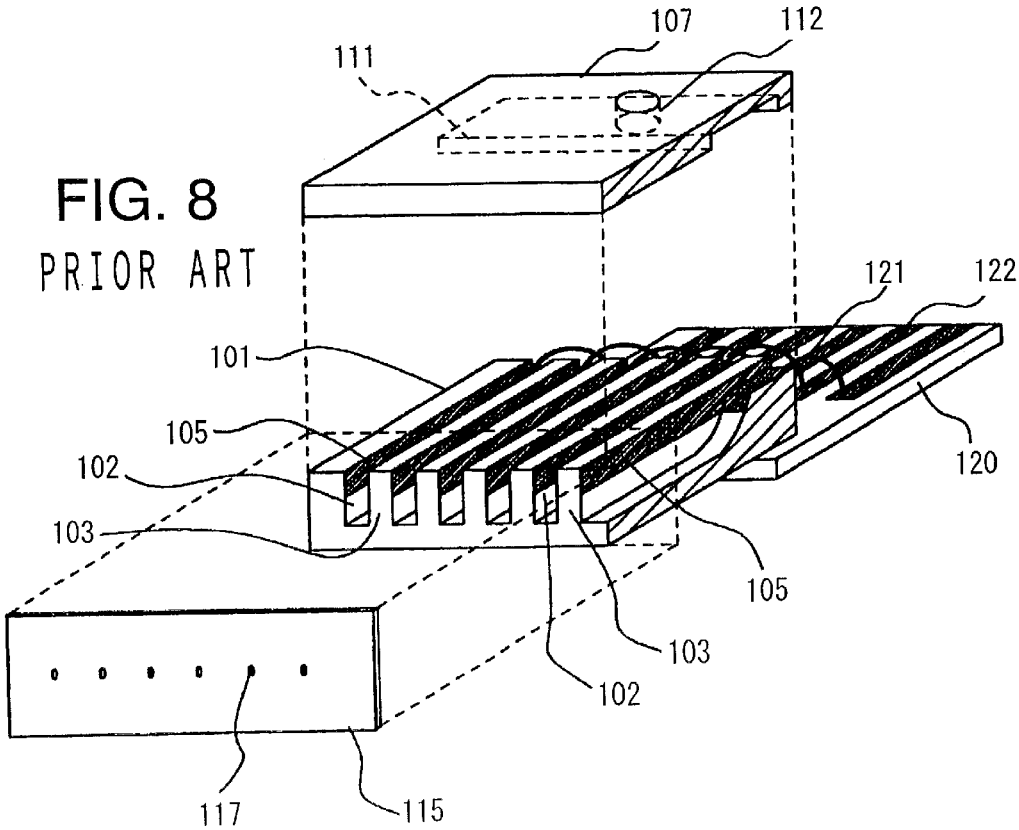
FIG. 8 PRIOR ART
FIG. 8 is an exploded perspective view showing schematically a recording head according to a conventional technique.
Figure 9A:
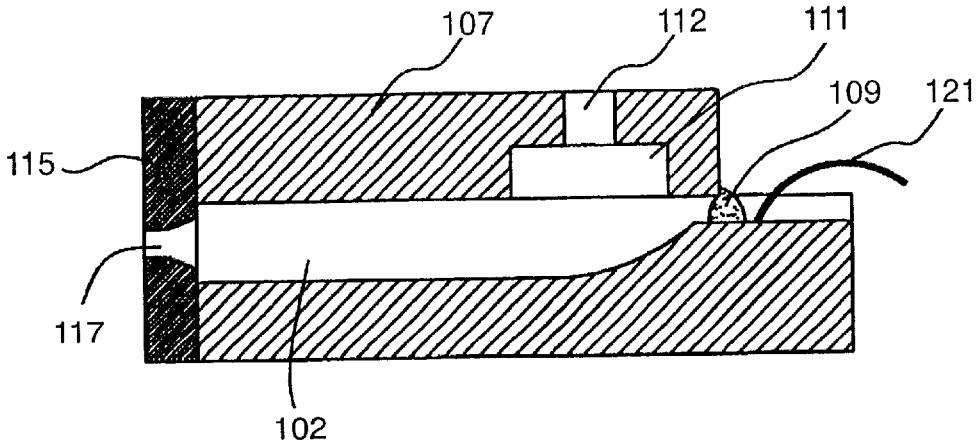
FIG. 9A PRIOR ART
FIG. 9 is a sectional view showing schematically a recording head according to the conventional technique.
Figure 9B:
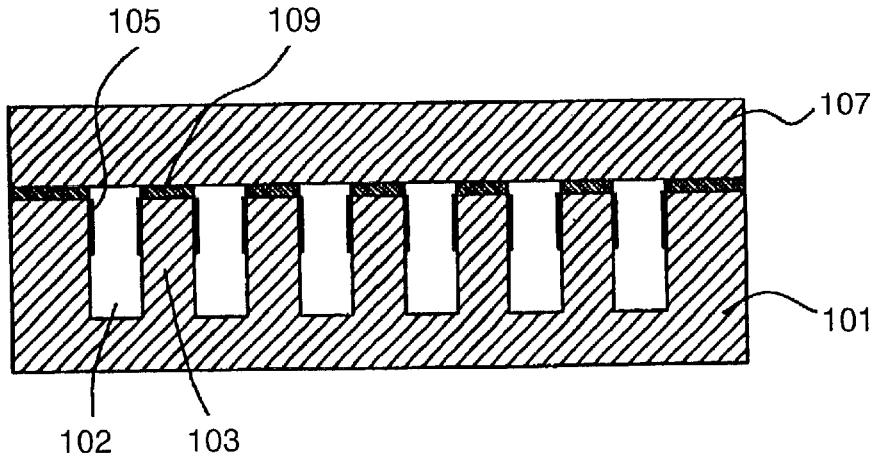
FIG. 9B PRIOR ART

Note that, in use of such an ink jet head, for instance, the ink jet head is combined with a tank holder which retains an ink cartridge so as to be freely attached or detached and then is mounted on a carriage equipped to an ink jet recording apparatus. FIG. 7 schematically shows its embodiment mode as an example.

As shown in FIG. 7, a carriage 61 is mounted on a pair of guide rails 62*a* and 62*b* in a direction of a shaft so as to be movable. The carriage 61 is conveyed through a timing belt 65 traversed between a pulley 64*a* that is provided at one end side of a guide rail 62 and connected with a carriage driving motor 63 and a pulley 64*b* that is provided with the other end side. At both sides of a direction orthogonal to the direction that the carriage 61 is conveyed, a pair of conveying rollers 66 and 67 are respectively provided along the guide rails 62*a* and 62*b*. These conveying rollers 66 and 67 are given for conveying a medium to be recorded S to a direction orthogonal to the direction in which the carriage 61 is conveyed, toward a lower position of the carriage 61.

In such an ink jet recording apparatus, the carriage 61 is scanned to the direction orthogonal to the direction in which the carriage 61 is conveyed while the medium to be recorded S is conveyed, resulting in that the ink jet head records characters and images on the medium to be recorded S.

(Another Embodiment)

In the above-described two embodiments, a judging means for judging the ink filling state is equipped in inside of an ink jet head. However, the judging means may be formed so as to be separated from the ink jet head. For instance, the judging means may be mounted on the circuit substrate in which a control circuit of the ink jet recording apparatus is accommodated.

As described above, according to the present invention, a detection apparatus specially provided and the like is not needed. By a commonly used electronic circuit, it is possible to judge in advance whether ink inside a passage is in a proper state or not, where there is not consumed any ink and recording medium that are used for verification, to thereby exhibit a remarkable effect in reduction of printing cost and enhancement of printing quality.

What is claimed is:

1. An ink jet head for changing a volume of an ink passage with application of a driving voltage to an electrode, provided on side walls of the ink passage formed on a piezoelectric ceramic plate, and ejecting ink, filled in the interior thereof through a nozzle opening, comprising:

a signal processing means for processing a piezoelectric signal generated on an electrode provided on each of the side walls of the ink passage;

a selection means composed of a group of switches equipped for connecting the electrode, provided on each of the side walls of the ink passage, with any one of the driving voltage, a reference voltage and the signal processing means; and a control means for controlling the selection means, wherein the control means is provided with a judging means for judging a filling state of ink in the ink passage through controlling the selection means, driving one of the side walls adjacently disposed in said ink passage and detecting a piezoelectric signal generated on the other one of the side walls.

2. An ink jet head according to claim 1; further comprising a diagnosis signal generating means for generating a diagnosis signal for driving the side walls of the ink passage; and a signal switching means for selecting any one of the driving voltage and the diagnosis signal to connect with the selection means, wherein the diagnosis signal is connected with the selection means by the signal switching means in detection of a filling state of ink and the diagnosis signal is applied to one of the side walls adjacently disposed, which is selected by the selection means.

3. An ink jet head according to claim 2, wherein the driving means is composed of a pulse generating circuit.

4. An ink jet head according to claim 2, wherein the driving means is composed of a sine wave generating circuit.

5. An ink jet head according to claim 2, wherein the driving means is composed of a sweep signal generating circuit.

6. An ink jet recording apparatus having an ink jet head for changing a volume of an ink passage with application of a driving voltage to an electrode, provided on side walls of the ink passage formed on a piezoelectric ceramic plate, and ejecting ink, filled in the interior thereof through a nozzle opening, comprising:

a signal processing means for processing a piezoelectric signal generated on an electrode provided on each of the side walls of the ink jet head;

a selection means composed of a group of switches equipped for connecting the electrode, provided on each of the side walls of the ink passage, with any one of the driving voltage, a reference voltage and the signal processing means; and a control means for controlling the selection means, wherein the control means is provided with a judging means for judging a filling state of ink in the ink passages through controlling the selection means, driving one of the side walls adjacently disposed in said ink passage and detecting a piezoelectric signal generated on the other one of the side walls.

7. An ink jet recording apparatus according to claim 6, further comprising a diagnosis signal generating means for generating a diagnosis signal for driving the side walls of the ink passage; and a signal switching means for selecting any one of the driving voltage and the diagnosis signal to connect with the selection means, wherein the diagnosis signal is connected with the selection means by the signal switching means in detection of a filling state of ink and said diagnosis signal is applied to one of the side walls adjacently disposed, which is selected by the selection means.

8. An ink jet recording apparatus according to claim 6, wherein the driving means is composed of a pulse generating circuit.

9. An ink jet recording apparatus according to claim 6, wherein the driving means is composed of a sine wave generating circuit.

10. An ink jet recording apparatus according to claim 6, wherein the driving means is composed of a sweep signal generating circuit.

* * * * *